US008714465B2

(12) United States Patent
Heyse et al.

(10) Patent No.: US 8,714,465 B2
(45) Date of Patent: May 6, 2014

(54) VALVE FOR ATOMIZING A FLUID

(75) Inventors: Joerg Heyse, Besigheim (DE); Hartmut Albrodt, Tamm (DE); Kerstin Koch, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 509 days.

(21) Appl. No.: 13/063,234

(22) PCT Filed: Sep. 2, 2009

(86) PCT No.: PCT/EP2009/061320

§ 371 (c)(1),
(2), (4) Date: Mar. 10, 2011

(87) PCT Pub. No.: WO2010/028987

PCT Pub. Date: Mar. 18, 2010

(65) Prior Publication Data

US 2011/0163187 A1 Jul. 7, 2011

(30) Foreign Application Priority Data

Sep. 15, 2008 (DE) ..... 10 2008 042 116

(51) Int. Cl.

| | |
|---|---|
| ***B05B 1/30*** | (2006.01) |
| ***B05B 1/34*** | (2006.01) |
| ***F02M 59/00*** | (2006.01) |
| ***F02M 61/00*** | (2006.01) |

(52) U.S. Cl.

USPC ..... 239/533.14; 239/533.3; 239/533.12; 239/596

(58) Field of Classification Search

CPC ..... B05B 1/30; B05B 1/34; B05B 1/3006; B05B 1/3013; F02M 59/00; F02M 61/00

USPC ..... 239/533.2, 533.3, 533.14, 533.12, 596

See application file for complete search history.

(56) References Cited

U.S. PATENT DOCUMENTS

| | | | | |
|---|---|---|---|---|
| 6,170,763 | B1 * | 1/2001 | Fuchs et al. | 239/533.12 |
| 6,405,945 | B1 * | 6/2002 | Dobrin | 239/463 |
| 6,530,349 | B2 | 3/2003 | Uneta | |

(Continued)

FOREIGN PATENT DOCUMENTS

| | | |
|---|---|---|
| DE | 102006044439 | 3/2008 |
| JP | 4292525 | 10/1992 |
| JP | 2007182807 | 7/2007 |

OTHER PUBLICATIONS

PCT/EP2009/061320 International Search Report.

*Primary Examiner* — Justin Jonaitis

(74) *Attorney, Agent, or Firm* — Michael Best & Friedrich LLP

(57) ABSTRACT

A valve for atomizing fluid is specified, in particular an injection or metering valve for fuel injection or exhaust-gas systems of motor vehicles, which valve has a valve seat body (11) with a valve seat (14) which surrounds a valve opening (13), a perforated injection disc (17) which bears against the front side of the valve seat body (12) downstream of the valve opening (13) and has at least one spray hole (18) which is offset radially with respect to the valve opening (13), and an inflow cavity (19) which is present between the valve opening (13) and the at least one spray hole (18). For the inexpensive and reproducible production of a stable, corrosion-resistant perforated injection disc (18) with improved atomization of the ejected fluid, the inflow cavity (19) is formed by at least one depression (20) which is made in that disc face of the perforated injection disc (17) which faces the valve seat body (12), in such a way that part of the depression (20) protrudes into the valve opening (13) and the remaining part of the depression (20) is covered by the valve seat body (12). The at least one spray hole (18) is made in that part of the depression (20) which is covered by the valve seat body (12), close to the depression wall, which faces away from the valve opening (13), into the bottom (201) of the depression (20).

19 Claims, 2 Drawing Sheets

(56) References Cited

U.S. PATENT DOCUMENTS

| | | | | |
|---|---|---|---|---|
| 7,137,576 | B2 | 11/2006 | Xu | |
| 7,472,838 | B2 | 1/2009 | Omura et al. | |
| 2005/0194458 | A1 * | 9/2005 | Bierstaker et al. | 239/5 |
| 2006/0097075 | A1 | 5/2006 | Goenka et al. | |
| 2006/0097080 | A1 | 5/2006 | Goenka et al. | |
| 2006/0097081 | A1 | 5/2006 | Goenka et al. | |
| 2009/0200402 | A1 * | 8/2009 | Gesk et al. | 239/533.12 |
| 2009/0321540 | A1 | 12/2009 | Heyse et al. | |

* cited by examiner

FIG. 1
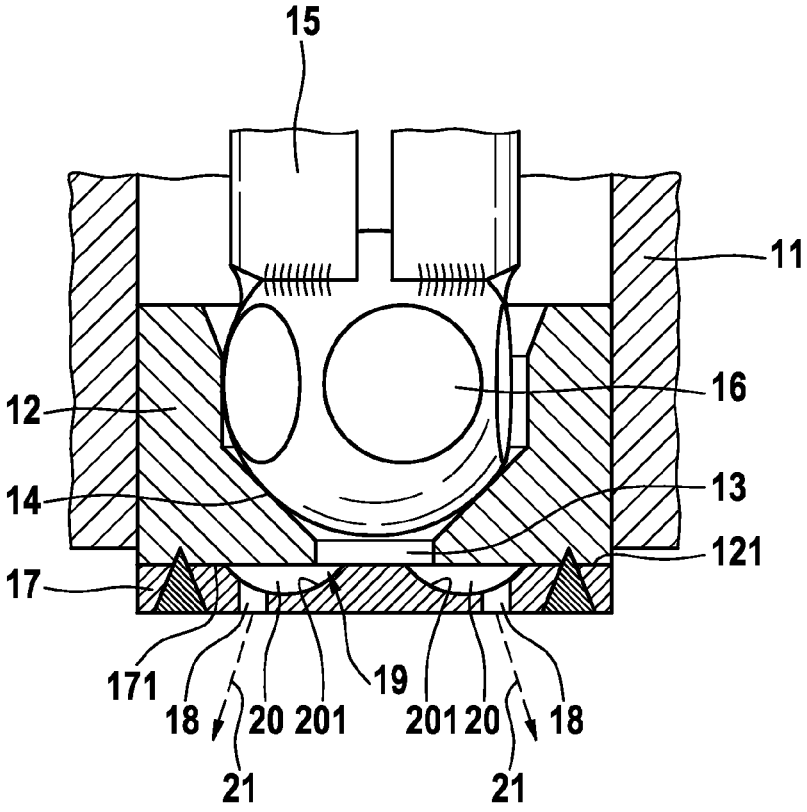
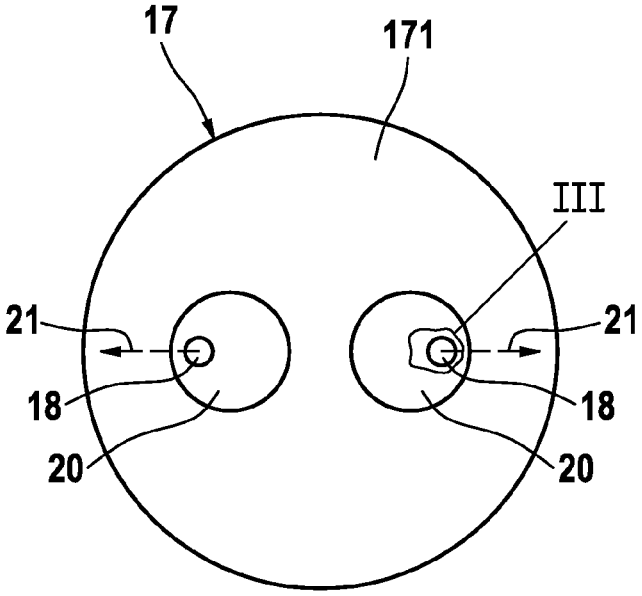
FIG. 2
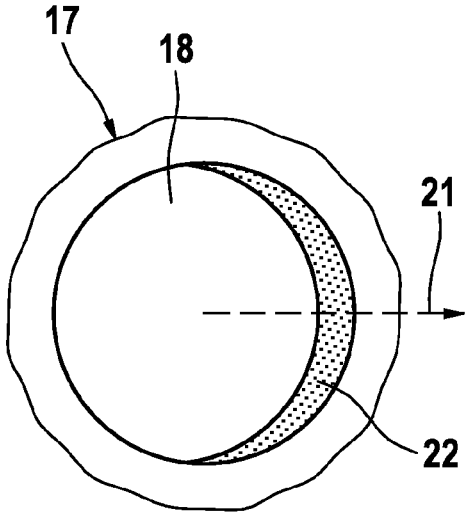
FIG. 3

FIG. 4
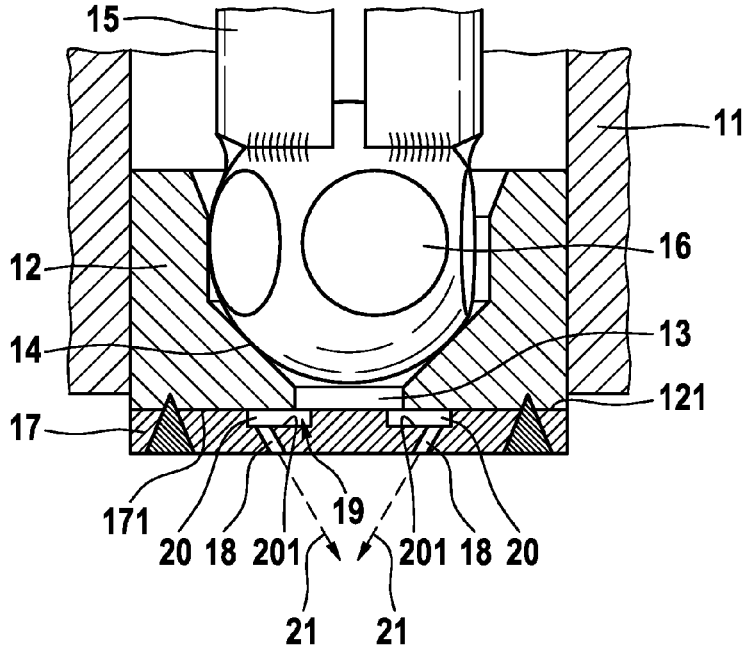
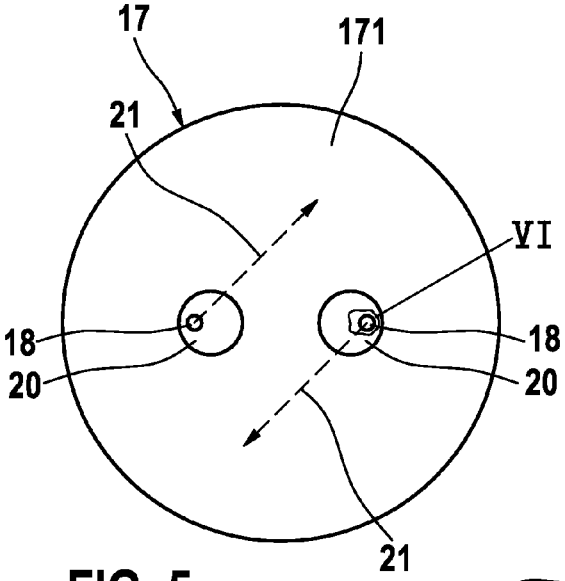
FIG. 5
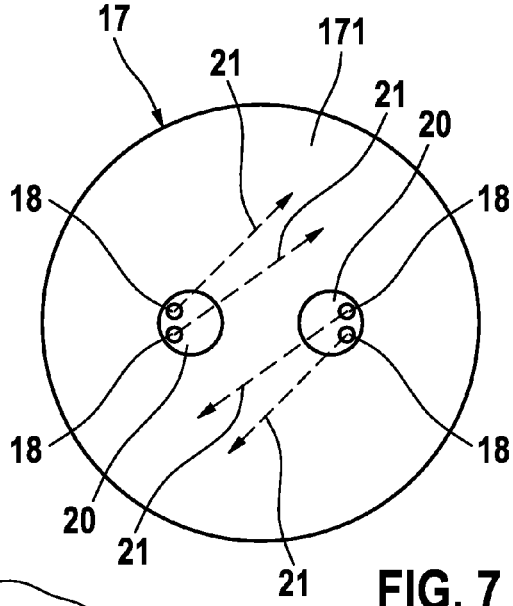
FIG. 7
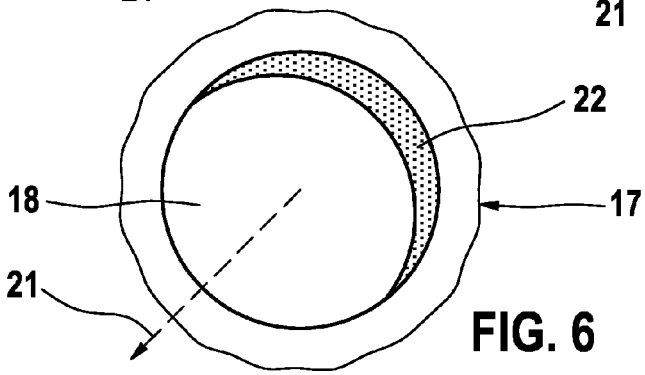
FIG. 6

VALVE FOR ATOMIZING A FLUID

BACKGROUND OF THE INVENTION

The invention relates to a valve for atomizing a fluid, in particular an injection and/or metering valve for fuel injection or exhaust systems in internal combustion engines.

In a known fuel injection valve for fuel injection systems of internal combustion engines (DE 10 2006 041 475 A1), the inflow cavity is formed, as a circular recess, into that end surface of the valve seat body which faces toward the spray hole disk, and said inflow cavity extends over the valve opening and over those openings of the spray holes in the spray hole disk which face toward the valve seat carrier. The hole axes of the spray holes are aligned parallel to one another and to the axis of the valve seat body. The spray holes, which are arranged on a pitch circle, all have the same shape, the contour of which is triangular, in the form of a truncated triangle, semicircular, in the form of a truncated semicircle, semielliptical, in the form of a truncated semiellipse, in the form of a triangle truncated in a rounded manner, semicircular or semielliptical with rounded inlet edges, or of similar design. Here, all the spray hole shapes are contoured such that a tapering of the spray hole is provided on the side opposite the inflow side, that is to say radially outward. As a result of said contour, the fluid jet which fans out directly after exiting the spray hole is constricted again in the radially outer region, such that comparatively large droplets remain as an envelope in the outer region of the ejected fluid hollow conical lamella. In internal combustion engines with intake pipe injection, it is achieved by means of this spray hole geometry that, in the first start cycles (cold start) of the internal combustion engine with externally-applied ignition, the outer droplets of the ejected fuel spray are deposited as wall film on the intake pipe walls. In this way, in the first start cycles, only the finely atomized droplets which are present in the center of the jet, and a correspondingly high fuel vapor component, pass directly into the combustion chamber, and the poorly prepared mixture component is supplied to the combustion chamber only after a delay, such that the best-prepared mixture component is introduced into the combustion chamber in the start cycle, and the exhaust-gas emissions are considerably reduced during this time.

SUMMARY OF THE INVENTION

The valve according to the invention has the advantage of having a spray hole disk which can be produced at low cost and in a reproducible manner and which provides improved atomization of the ejected fluid, for example of fuel or urea-water solutions. The spray hole disk is suitable for mass production from a non-corrosive material, for example rust-resistant steel, wherein cycle times can be kept low by stamping the depressions and fine-blanking the spray holes. As a result of the relocation of the inflow cavity out of the valve seat body and into the spray hole disk, additional costs for the machining of the valve seat body are eliminated. As a result of the depressions, which represent the inflow cavity, in the spray hole disk, which depressions firstly extend as far as under the valve opening and secondly are covered in the region of the spray holes by the valve seat body, an S-shaped flow is attained in which the fluid flow emerging from the valve opening is deflected twice. This S-shape promotes the fanning-out of the flow, which assists atomization, in the spray hole. Furthermore, the depressions make it possible, while maintaining a thickness which is adequate for the stability and strength of the spray hole disk, to shorten the spray hole length to such an extent that the spray hole flow can emerge from each spray hole fanned out to an adequate extent for ideal atomization, that is to say the flow outlet vectors are not bundled in parallel in the spray hole.

In one advantageous embodiment of the invention, the at least one spray hole in the depression is arranged close to that wall of the depression which faces away from the valve opening, with the base area of the depression being a multiple larger than the cross section of the at least one spray hole. In this way, in the flow entry region of the spray hole within the depression, a transverse vortex system is generated which has vortex axes parallel to the vertical axis of the spray hole disk. Said transverse vortex system, by means of flow rotation, assists the fanning-out of the fluid jet emerging from the respective spray hole.

In one advantageous embodiment of the invention, the at least one depression has a circular, oval or elliptical cross section. The transverse vortex system can be influenced in a targeted manner by means of such a cross-sectional shape.

In one advantageous embodiment of the invention, the at least one spray hole may be punched perpendicularly or obliquely with respect to the disk surface, with the oblique slope running toward the center of the disk. By means of such an oblique slope of the at least one spray hole, a maximum flow deflection takes place from the depression into the spray hole, as a result of which, in the extreme case, a two-phase field (fluid, air) is generated in the spray hole. Here, the deflection forces press the liquid onto that part of the spray hole wall which is situated opposite the inflow side of the spray hole. As a result of the deflection forces which exert a pressure on the spray hole wall, the fluid flow is spread out along the spray hole wall. The fluid flow is deformed, in terms of cross section, into the shape of a sickle which bears at one side against the spray hole wall, and is fanned out along the circumference of the spray hole. As a result, a fanning-out fluid lamella with improved atomization emerges from the spray hole.

In the case of a plurality of spray holes being provided in the at least one depression, the spray holes are located in the at least one depression such that the flow vectors of the fuel spray emerging from the spray holes diverge, in order that the fluid fans emerging from the spray holes do not impinge on one another.

BRIEF DESCRIPTION OF THE DRAWINGS

The invention will be explained in more detail in the following description on the basis of exemplary embodiments illustrated in the drawings, in which:

FIG. 1 shows a longitudinal section of a detail of a valve for atomizing fluid, FIG. 2 shows a plan view of a spray hole disk in the valve according to FIG. 1, FIG. 3 shows, in an enlarged illustration, a view of the detail III in FIG. 2 from below, FIG. 4 shows an illustration similar to that in FIG. 1, with a modified spray hole disk, FIG. 5 shows a plan view of the spray hole disk in FIG. 4, FIG. 6 shows, in an enlarged illustration, a view of the detail VI in FIG. 5 from below, FIG. 7 shows a plan view of a further, modified spray hole disk.

DETAILED DESCRIPTION

The valve illustrated in FIG. 1 by way of a longitudinal section of a detail of its ejection-side end serves for the metered injection and atomization of fluid, for example of fuel in fuel injection systems of internal combustion engines or of urea-water solutions in exhaust systems of internal combustion engines for the reduction of nitrogen oxides in the exhaust gas.

The valve has a tubular valve seat carrier 11 whose ejection-side end is closed off by a valve seat body 12. The valve seat body 12 is pushed into the end of the valve seat carrier 11 and is connected thereto in a cohesive fashion, for example by welding. The valve seat body 12 has a valve opening 13 which is surrounded by a valve seat 14 formed on the valve seat body 12. A valve needle 15 which is actuated by an actuator, for example an electromagnet, serves for opening up and closing off the valve opening 13, which valve needle 15 bears a spherical valve closing body 16 on its end. The valve closing body 16 is pushed against the valve seat 14 by means of a valve closing spring (not illustrated here) which applies a load to the valve needle 15, and said valve closing body 16 is raised up from the valve seat 14 counter to the spring force of the valve closing spring when the actuator is activated. The magnitude of the lift travel of the valve closing body 16, and the time for which the valve opening 13 is opened up by the valve closing body 16, determines the fluid quantity which emerges via the valve opening 13.

For the fine atomization of the fluid quantity which emerges at high pressure from the valve opening 13, the valve seat body 12 is assigned, downstream of the valve opening 13, a spray hole disk 17 which is fastened to the end side of the valve seat body 12 in a preferably cohesive fashion, for example by welding. The spray hole disk 17, which is composed of corrosion-resistant material, for example rust-resistant steel, is provided with one or more spray holes 18 depending on the required spray pattern, which spray holes 18 are connected via an inflow cavity 19 to the valve opening 13. The inflow cavity 19 is composed of at least one depression 20 in the spray hole disk 17, which depression 20 is formed proceeding from that disk surface 171 which faces toward the valve seat body 12. In the exemplary embodiments illustrated here, the inflow cavity 19 is composed of a total of two depressions 20, but the number of depressions 20 is arbitrary and is dependent on the desired spray pattern and the number of spray holes 18. The depressions 20 are arranged on a concentric pitch circle so as to be offset relative to one another by equal circumferential angles. The depressions 20 are preferably stamped into the spray hole disk 17 and have a circular, oval or elliptical shape. Here, the base 201 of the depression may be concavely curved (FIG. 1) or planar (FIG. 4), with the base area of the base 201 being a multiple larger than the cross section of the at least one spray hole 18 formed into the base 201 of the depression 20. The depressions 20 are arranged in the spray hole disk 17 in such a way that a part of each depression 20 projects into the valve opening 13, in effect running under the valve opening 13, and the remaining part, in which the at least one spray hole 18 is also situated, of the depression 20 is covered by the end surface 121 of the valve seat body 12. In each depression 20, the spray hole 18 is arranged close to that wall of the depression 20 which faces away from the valve opening 13. By means of this flow geometry, for the inflow to the spray hole 18, a flow path is formed which runs in the form of an S-shaped flow from the valve opening 13 via the depression 20 and into the spray hole 18. This S-shape promotes the fanning-out of the flow, which assists atomization, in the spray hole 18. Within the depression 20, in the flow entry region of the spray hole 18, a transverse vortex system is generated which has vortex axes parallel to the vertical axis of the spay hole disk 17. Said transverse vortex system, by means of flow rotation, assists the fanning-out of the fluid jet emerging from the spray hole 18. The transverse vortex system may be influenced in a targeted manner by the shape, already discussed above, of the depression 20. The spray hole 18 may be formed with various cross-sectional shapes, for example round, elliptical, oval or polygonal.

The spray hole axes of the spray holes 18 may be aligned in any desired direction relative to the disk surface. In the exemplary embodiment of FIGS. 2 and 3, the spray holes are punched perpendicular to the disk surface. In the exemplary embodiment of FIGS. 4 to 6, the spray holes 18 are punched obliquely with respect to the disk surface, with said spray holes 18 being inclined relative to the disk surface toward the center of the disk by an acute angle. In both cases, as a result of the deflection forces generated during the flow deflection from the depression 20 into the spray hole 18, the fluid is pressed against that part of the spray hole wall which is situated opposite the inflow side of the spray hole 18. The rest of the spray hole 18 is filled with air. Since the fluid has a free surface in the spray hole 18, the fluid strand is "spread out" along the spray hole wall as a result of the deflection forces which exert a pressure on the spray hole wall. The fluid strand is deformed in its cross section into the shape of a sickle 22 which bears at one side against the spray hole wall, as illustrated, in an enlarged illustration, in the view of the spray hole 18 from below in FIGS. 3 and 6.

The same effect is obtained with obliquely running spray holes 18, as shown in FIG. 4. As a result of the deflection forces, which are however greater, arising during the flow deflection from the depression 20 into the oblique spray hole 18, this effect of the fluid strand being "spread out" is intensified, such that a considerably larger or longer sickle 22 of the fluid strand is formed along the spray hole wall, as can be seen from a comparison of FIG. 3 and FIG. 6. The outlet flow vector 21 of the atomized fluid lamella thus emerging from the spray hole 18 is denoted in FIGS. 1 to 6 by 21.

The exemplary embodiment of the valve illustrated in longitudinal section in FIG. 4 differs from the exemplary embodiment described above merely by the modifications, already discussed above, of the spray hole disk 17. Firstly, the depressions 20 are stamped into the spray hole disk 17 not in the form of a basin with a concavely curved base 201, as in FIG. 1, but rather in the form of a cylinder with a planar base 201. Secondly, the spray holes 18 are punched obliquely such that the spray hole axes are inclined relative to the spray hole surface toward the center of the disk by an acute angle. In order that the outlet flow vectors 21 directed toward the center of the disk do not impinge on one another and can avoid one another, the two depressions 20 are correspondingly designed such that the fluid strand in the two spray holes 18 situated opposite one another also has superposed on it a speed component in the circumferential direction, which speed component may vary from one spray hole 18 to another but is preferably in the same direction of rotation for all spray holes 18.

In the plan view of a further exemplary embodiment of the spray hole disk 17 illustrated in FIG. 7, two spray holes 18 are provided in each of two depressions 20 arranged in the spray hole disk 17, which spray holes 18 are punched obliquely with respect to the disk surface in the exemplary embodiment of FIG. 7, as in FIG. 4. Those spray holes 18 which again are arranged close to that wall of the depression 20 which faces away from the inflow side of the depression are located such that the outlet flow vectors 21 of the two spray holes 18 provided in a depression 20 diverge from one another.

What is claimed is:

1. A valve for atomizing fluid, the valve comprising: a valve seat body (12) which has a valve seat (14) surrounding a valve opening (13), a spray hole disk (17) which bears against an end side of the valve seat body (12) downstream of the valve opening (13) and which has at least one spray hole (18) offset radially with respect to the valve opening (13), and an inflow cavity (19) provided between the valve opening (13) and the at least one spray hole (18), characterized in that the inflow cavity (19) is formed by at least one concavely curved depression (20) which is arranged in a disk surface of the spray hole disk (17) which faces toward the valve seat body (12), in such a way that a part of the depression (20) projects into the valve opening (13) and a remaining part of the depression (20) is covered by the valve seat body (12), and in that the at least one spray hole (18) is formed into a base (201) of the depression (20) within the part of the depression (20) which is covered by the valve seat body (12).

2. The valve as claimed in claim 1, characterized in that the at least one spray hole (18) formed into the base (201) of the depression (20) is situated close to a wall of the depression (20) which faces away from the valve opening (13).

3. The valve as claimed in claim 1, characterized in that a base area of the at least one depression (20) is a multiple larger than a cross section of the at least one spray hole (18) arranged therein.

4. The valve as claimed in claim 1, characterized in that the at least one depression (20) has one of a circular, oval and elliptical shape.

5. The valve as claimed in claim 1, characterized in that the at least one spray hole is formed into the spray hole disk (17) in such a way that a spray hole axis is aligned parallel to a vertical axis of the spray hole disk (17).

6. The valve as claimed in claim 1, characterized in that the at least one spray hole is formed into the spray hole disk (17) in such a way that a spray hole axis is aligned so as to be inclined relative to the disk surface toward a center of the disk by an acute angle.

7. The valve as claimed in claim 1, characterized in that, there are a plurality of spray holes (18) provided in the at least one depression (20), each spray hole having a spray hole axis, the spray hole axes are aligned.

8. The valve as claimed in claim 1, characterized in that, there are a plurality of spray holes (18) provided in the at least one depression (20), the spray holes (18) are arranged such that flow outlet vectors of fanning-out fluid lamellae emerging from the spray holes (18) diverge.

9. The valve as claimed in claim 1, characterized in that, there are a plurality of depressions (20) provided in the spray hole disk (17), vertical axes of the depressions (20) are offset relative to one another, with an identical radial spacing to a vertical axis of the spray hole disk (17), by equal circumferential angles.

10. The valve as claimed in claim 1, characterized in that the at least one spray hole (18) has one of a round, elliptical, oval and polygonal cross-sectional shape.

11. The valve as claimed in claim 1, characterized in that, there are a plurality of spray holes (18) provided in the at least one depression (20), each spray hole having a spray hole axis, the spray hole axes are not aligned.

12. The valve as claimed in claim 1, wherein the valve is a fuel injection valve for a fuel injection system of an internal combustion engine.

13. The valve as claimed in claim 1, wherein the valve is a metering valve for an exhaust system of an internal combustion engine.

14. A valve for atomizing fluid, the valve comprising: a valve seat body (12) which has a valve seat (14) surrounding a valve opening (13), a spray hole disk (17) which bears against an end side of the valve seat body (12) downstream of the valve opening (13) and which has four spray holes (18) offset radially with respect to the valve opening (13), and an inflow cavity (19) provided between the valve opening (13) and the spray holes (18), characterized in that the inflow cavity (19) is formed by two depressions (20) which are arranged in a disk surface of the spray hole disk (17) which faces toward the valve seat body (12), in such a way that parts of the depressions (20) project into the valve opening (13) and remaining parts of the depressions (20) are covered by the valve seat body (12), and wherein the four spray holes (18) includes two spray holes (18) formed into bases (201) of each of the depressions (20) within the parts of the depressions (20) which are covered by the valve seat body (12), and wherein the two spray holes (18) in each depression (20) are angled relative to the disk surface generally toward a center of the disk (17), and wherein the two spray holes (18) in each depression (20) are arranged such that flow outlet vectors of fluid lamellae emerging from the two spray holes (18) diverge from one another.

15. The valve as claimed in claim 14, characterized in that base areas of the depressions (20) are multiples larger than cross sections of the spray hole (18) arranged therein.

16. The valve as claimed in claim 14, wherein the depressions (20) are cylindrical.

17. The valve as claimed in claim 14, wherein the outlet vectors of the fluid lamellae emerging from each of the four spray holes (18) do not impinge on one another.

18. The valve as claimed in claim 14, wherein the valve is a fuel injection valve for a fuel injection system of an internal combustion engine.

19. The valve as claimed in claim 14, wherein the valve is a metering valve for an exhaust system of an internal combustion engine.

* * * * *